US012385195B2

(12) United States Patent
Kim

(10) Patent No.: US 12,385,195 B2
(45) Date of Patent: Aug. 12, 2025

(54) ROAD STUD

(71) Applicant: ROADCARE CO., LTD., Gyeonggi-do (KR)

(72) Inventor: Chang Geun Kim, Gyeonggi-do (KR)

(73) Assignee: ROADCARE CO., LTD., Gyeonggi-do (KR)

( * ) Notice: Subject to any disclaimer, the term of this patent is extended or adjusted under 35 U.S.C. 154(b) by 573 days.

(21) Appl. No.: 17/784,763

(22) PCT Filed: Nov. 11, 2020

(86) PCT No.: PCT/KR2020/015764
§ 371 (c)(1),
(2) Date: Jun. 13, 2022

(87) PCT Pub. No.: WO2021/118075
PCT Pub. Date: Jun. 17, 2021

(65) Prior Publication Data

US 2023/0002982 A1 Jan. 5, 2023

(30) Foreign Application Priority Data

Dec. 13, 2019 (KR) ..... 10-2019-0167118

(51) Int. Cl.
*E01F 9/529* (2016.01)
*E01F 9/524* (2016.01)
*E01F 9/576* (2016.01)

(52) U.S. Cl.
CPC ..... *E01F 9/578* (2016.02); *E01F 9/524* (2016.02); *E01F 9/529* (2016.02)

(58) Field of Classification Search
CPC . E01F 9/529; E01F 9/553; E01F 9/565; E01F 9/571; E01F 9/588
See application file for complete search history.

(56) References Cited

U.S. PATENT DOCUMENTS 1,777,585 A * 10/1930 Springer ..... E01F 9/571 404/11
1,830,319 A * 11/1931 Hartzler ..... E01F 9/553 404/15
4,737,049 A * 4/1988 Callhan ..... E01F 9/565 404/11
5,895,170 A * 4/1999 Chambers ..... E01F 9/677 404/11

(Continued)

FOREIGN PATENT DOCUMENTS

EP 2055839 A2 * 5/2009 ..... E01F 9/529
FR 3036714 A1 * 12/2016

(Continued)

OTHER PUBLICATIONS

International Search Report in PCT/KR2020/015764 dated Feb. 22, 2021 and its English translation, 4 pgs.

*Primary Examiner* — Gary S Hartmann
(74) *Attorney, Agent, or Firm* — Young Basile Hanlon & MacFarlane, P.C.

(57) ABSTRACT

A road stud includes a base having a drainage path and a portion that generates sound when pressed. A fixing portion is screwed into the base, and a dome shaped cap is fixed onto the base. The sound generating portion passes through a path in a light reflective portion, which is fixed onto a height surface of the base.

11 Claims, 10 Drawing Sheets

(56) References Cited

U.S. PATENT DOCUMENTS

| | | | | |
|---|---|---|---|---|
| 6,062,766 | A | 5/2000 | Fleury et al. | |
| 9,534,351 | B2 * | 1/2017 | Paulos | E01F 9/571 |

FOREIGN PATENT DOCUMENTS

| | | | | | |
|---|---|---|---|---|---|
| GB | 2517193 | A | * | 2/2015 | E01F 9/559 |
| KR | 200370253 | Y1 | | 12/2004 | |
| KR | 10-2005-0024814 | A | | 3/2005 | |
| KR | 10-2008-0090644 | A | | 10/2008 | |
| KR | 20120050798 | A | * | 5/2012 | |
| KR | 10-2014-0013666 | A | | 2/2014 | |
| KR | 10-2014-0077069 | A | | 6/2014 | |
| KR | 101842711 | B1 | | 3/2018 | |

* cited by examiner

ROAD STUD

TECHNICAL FIELD

The present disclosure relates to a road stud and, more specifically, to road studs are provided at regular intervals on the surface of a road, such as the center line, edge, or branch line of a roadway, to enable drivers to easily and visually identify lanes and to recognize lane departures or lane invasions through the sensation of vibration or auditory sensation of sound.

BACKGROUND

In general, a road stud is provided so that drivers may easily recognize lanes, particularly center lines, and is a device provided at regular intervals on the surface of a road, such as the center line, edge, and branch line of the surface of a roadway.

Such road studs may be provided to protrude from the surface of a road, and therethrough, when a vehicle is stepped on and passed, a driver may easily recognize lane departure due to the rattling of the vehicle. In addition, a reflector that reflects light to the outside may be additionally provided, so that the driver may easily distinguish lanes through light reflection of road studs even at night.

However, because the conventional road stud is provided such that a body protruding to the outside and a buried member buried in the ground are coupled through a bolt, and the buried member is simply embedded in the road, there is a drawback in that it is difficult to replace.

In addition, the conventional road stud has a drawback that foreign substances such as dust are attached to the reflector over time so that the reflector may not perform its role, and a driver may not sufficiently recognize the road stud by simply delivering visual information.

In addition, the conventional road stud is made of a material with high thermal conductivity, such as iron and aluminum. When the temperature rises in the summer season while it is provided on an asphalt road, the road stud is heated, and accordingly, asphalt melts and weakens in the area where road studs are provided. When a vehicle passes by stepping on the road stud, the road stud is buried in the asphalt weakened by the load of the vehicle, so there is a drawback in that a driver may not identify the road stud, which means a loss of function of the road stud.

In order to obviate this drawback, a patent published as Korean Patent No. 10-1842711 (Title: Road Stud; Filing Date: Sep. 27, 2017) was recently introduced, and discloses that a road stud includes: a body installed with a squeaker; an anchor coupled to the body, extended to the bottom, and stuck to the ground surface; a soft cap secured on an upper surface of the body to cover the squeaker, and deformed by external force to penetrate air through the squeaker; a central hole formed to have a central portion of the cap to be protruded upwardly; and a cover fixing the circumference of the body to the circumference of the cap, wherein an anchor installation hole into which an upper end of the anchor is inserted and installed is formed in the center of the body, the squeaker is installed on a circumferential surface of the anchor installation hole in a horizontal direction, an exhaust hole is formed in a circumference portion of the body so that the air that has passed through the squeaker may be smoothly discharged, the flow formed by compression of the cap flows into the anchor installation hole, passes through the squeaker, and is discharged to the exhaust hole, and a reflector is attached to the circumference of the body.

However, because the above-described conventional road stud is fixed by fastening the cap to the upper surface of the body with a bolt or screw, manufacturing is cumbersome, as well as installation and maintenance are cumbersome and difficult, that is, the operation of replacing the cap due to wear or damage of the cap is very cumbersome and difficult. Hence, there is a drawback that the risk of accidents is high because the time exposed to the dangers during replacement work on the road is long.

In addition, the conventional road stud has a drawback in that rainwater or road washing water permeates between the body and the cap and contaminates the inside as well as penetrates the squeaker. This makes the operation of the squeaker impossible.

In addition, in the conventional road stud, the squeaker is not only inserted inside the body but is also positioned to face the ground. Accordingly, even when the squeaker operates due to pressurization of the cap, there is a drawback in that the efficiency of diffusing the noise generated from the squeaker to the outside of the body, the cover, and the cap is extremely low.

In addition, the conventional road stud has a fixed structure in which the anchor is embedded in the road by pressurization, and as the frictional force and pressure of the tire is applied to the body and cap by vehicle driving, it flows in the hole of the road where the anchor is embedded, and eventually, there is a drawback in that the entire road stud is detached from the road.

SUMMARY

The present disclosure has been devised to obviate the above drawbacks of related art. An aspect of the present disclosure is directed to providing structurally improved road studs that are provided at regular intervals on the surface of a road, such as the center line, edge, or branch line of a roadway, so as to enable drivers to easily and visually identify lanes and recognize lane departures or lane invasions through the sensation of vibration or auditory sensation of sound. By providing an organic combination structure of a light reflection member that facilitates visual identification and a sound generation portion that enables auditory recognition, the reflection member is not detached even after long-term use. Simultaneously, the sound generated from the sound generation portion allows immediate diffusion to the outside, facilitates detachment of a cap from a base, allows rainwater or washing water flowing into a gap of the combined upper portion of the base and the cap to be quickly discharged, and firmly maintains a structure embedded in the road. In this way, the base may be easily detached from a fixing portion fixed to an installation part of the road.

An embodiment of the present disclosure is characterized by including a base 11. In the base 11, a coupling part 11*a* is formed through a center of a body with an inner space S formed, a mounting step 11*b* is formed to protrude on an inner edge of the body, a locking step 11*c* is formed to protrude inward in a state in which an outer upper end of the mounting step 11*b* protrudes upward, two to four drainage paths 11*d* are provided in an outer direction of the body from an inner surface between the mounting step 11*b* and the locking step 11*c*, and a drain 11*f* is provided in the form of a groove radially on a lower surface. Furthermore, a fixing portion 12 has an upper end inserted and screwed into the coupling part 11*a* of the base 11, and a lower end inserted into a groove 1 formed at an installation part of a road so that the base 11 is fixed to the installation part by curing a fixing member 2 injected into the groove 1. A cap 13 has elastic restoring force and has a dome shape in which a flange 13*a* is formed on an outer diameter so that the flange 13*a* is fitted and fixed in the groove between the mounting step 11*b* and the locking step 11*c* of the base 11 to generate air pressure by external pressure. A light reflection portion 15 is adhesively fixed to a height surface of the base 11 and reflects ambient light. A sound generation portion 16 directly radiates sound to the outside by air pressure generated while the cap 13 is pressed while being fitted and fixed in a path passing through the inner space S of the base 11 from an outside of the light reflection portion 15 and while pressing and fixing the reflection portion 15 to an outer surface of the base 11.

The coupling part 11*a* configuring the base 11 of an embodiment of the present disclosure is a polygonal or "+"-shaped through hole. The through hole is formed in an upwardly protruding part (shown in the attached drawing) or a downwardly protruding part (not shown in the attached drawing) from a central bottom surface of the body.

The fixing portion 12 of an embodiment of the present disclosure is a tubular fixture in which a flange 12*c* is formed on an upper outer diameter made of a synthetic resin material. A base coupling member 12*a* is formed to protrude from an upper surface of the flange 12*c* so as to be fitted and coupled to correspond to the coupling part 11*a* of the base 11, a screw coupling hole for fixing the base 11 is formed in the center of the base coupling member 12*a*, and a slit or rib 12*b*, which is a path through which the fixing member 2 penetrates before curing, is formed on an outer diameter of a tube body formed on a lower surface of the flange 12*c*.

The cap 13 of an embodiment of the present disclosure is characterized in that a light reflection member 17 is provided in a groove 13*b* formed on an upper surface.

The cap 13 of an embodiment of the present disclosure is characterized in that a logo of government agencies and its affiliated organizations, local governments or companies is displayed on an upper surface.

An embodiment of the present disclosure has the effect of facilitating a mounting and detachment of the cap 13 with respect to the base 11 by fitting and fixing the flange 13*a* in a closed state by pressing both upper sides of the cap 13 formed of the dome shape in a groove formed between the mounting step 11*b* formed to protrude on an inner edge of the body of the base 11 and the locking step 11*c* formed to protrude inward in a state in which an outer upper end of the body protrudes upward, or by lifting the upper both sides of the cap 13 which is fitted and fixed as described above while pressing the same, so that the flange 13*a* is departed and detached from the groove.

In addition, an embodiment of the present disclosure greatly reduces the installation and maintenance work time of a road stud 10 according to an embodiment of the present disclosure by facilitating a mounting and detachment of the cap 13 with respect to the base 11 as described above, thereby producing the effect of minimizing the exposure of workers to hazards on the road.

In addition, an embodiment of the present disclosure provides two to four drainage paths 11*d* from an inner surface between the mounting step 11*b* and the locking step 11*c* of the base 11 toward an outer direction of the body. When rainwater or road washing water flows between the locking step 11*c* and the cap 13 of the base 11, the water is quickly discharged, thereby producing the effects of preventing contamination inside the road stud 10, as well as preventing loss of function of a squeaker (e.g., the sound generation portion 16) caused when the introduced rainwater or washing water penetrates into the sound generation portion 16.

In addition, in an embodiment of the present disclosure, the drain 11*f* is provided in the form of a groove radially on a lower surface of the base 11, so that water flowing on the road during rain or road washing does not stay on or around the lower surface of the road stud 10 according to an embodiment of the present disclosure. The water is allowed to flow out quickly. Accordingly, it is possible to obtain the effect of preventing rainwater or washing water accumulated in the vicinity from flowing into the road stud 10.

In addition, in an embodiment of the present disclosure, in a state in which the fixing portion 12 is inserted into the groove 1 into which the fixing member 2 made of a liquid or fluid material such as epoxy is injected, by curing the fixing member 2 and allowing the fixing portion 12 to be firmly fixed to an installation part, an effect of maintaining firm fixing force of the base 11 to the installation part is obtained.

In addition, in an embodiment of the present disclosure, the actual fixing of the base 11 to an upper portion of the fixing portion 12 is made by screws (bolts) to facilitate replacement of the base 11, which is easily damaged or destroyed by friction or pressure with a tire according to the driving of a vehicle. In addition, the cap 13 is also easily replaced by the above-described detachable structure. In this way, by making it easy to replace, the economic improvement effect is obtained in the part which disassembles and stores the road stud 10 at the time of road repaving and enables reuse.

In addition, in an embodiment of the present disclosure, the coupling part 11*a*, which is a through-hole configuring the base 11, and the base coupling member 12*a*, which is a protruding part configuring the fixing portion 12, are formed in a polygonal or "+" shape, thereby preventing the base 11 from rotating with respect to the fixing portion 12 to which it is coupled. Preventing rotation prevents wear and a generation of a gap of the coupling part, thereby obtaining an effect of increasing coupling holding force.

In addition, an embodiment of the present disclosure obtains the effect of increasing the fixing force on an installation part by forming the slit or rib 12*b*, which is a path through which the fixing member 2 penetrates before curing, on an outer diameter of the fixing portion 12.

In addition, in an embodiment of the present disclosure, by attaching or printing the light reflection member 13*c* to the groove 13*b* formed on an upper surface of the cap 13, in addition to the light reflection portion 15 provided on an external height surface of the base 11, the visibility including night discrimination is further improved. Even when the base 11 goes inside the ground of the road due to external pressure for a long period of time, the light reflection member 13*c* provided on an upper portion of the cap 13 is always exposed to the outside, thereby obtaining the effect of semi-permanently maintaining light reflection function.

In addition, in an embodiment of the present disclosure, a logo of government agencies and its affiliated organizations or local governments or companies is printed or displayed in engraving/embossing shapes on an upper surface of the cap 13, thereby obtaining an effect of clearly displaying an installer or management subject of the road stud 10 according to an embodiment of the present disclosure.

DETAILED DESCRIPTION

Figure 1:
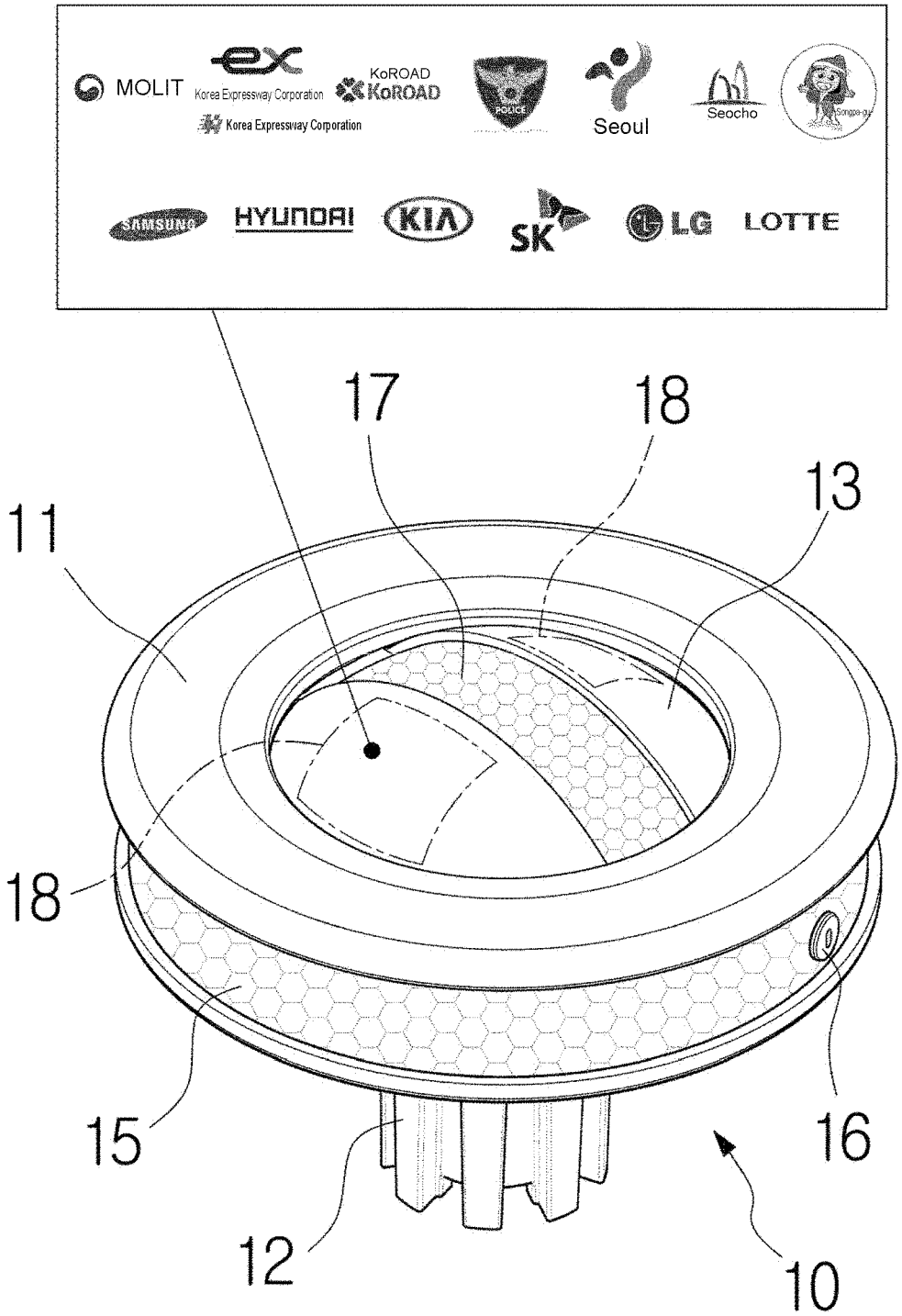
FIG. 1 is a perspective view illustrating the overall external configuration of an embodiment of the present disclosure.
Figure 2:
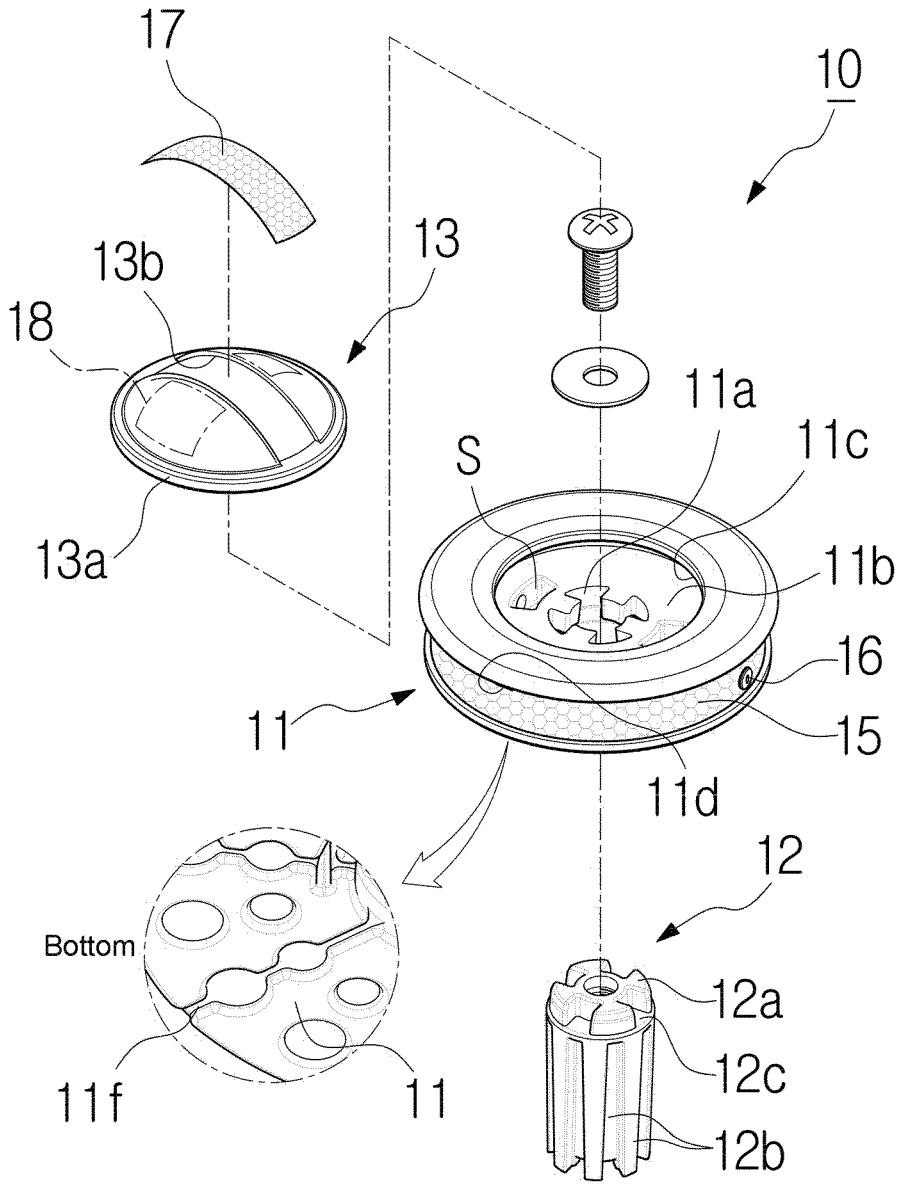
FIG. 2 is an exploded perspective view specifically illustrating the overall external configuration and the coupling structure of an embodiment of the present disclosure.

Hereinafter, the present disclosure will be described with reference to the accompanying drawings presented as described above.

As illustrated in FIGS. 1 to 5 of the accompanying drawings, the road stud 10 according to an embodiment of the present disclosure may include a base 11 in which a coupling part 11*a* is formed through a center of a body with an inner space S formed, a mounting step 11*b* is formed to protrude on an inner edge of the body, a locking step 11*c* is formed to protrude inward in a state in which an outer upper end of the mounting step 11*b* protrudes upward, two to four drainage paths 11*d* are provided in an outer direction of the body from an inner surface between the mounting step 11*b* and the locking step 11*c*, and a drain 11*f* is provided in the form of a groove radially on a lower surface. The road stud 10 may also include a fixing portion 12 in which an upper end is inserted and screwed into the coupling part 11*a* of the base 11, and a lower end is inserted into a groove 1 formed at an installation part of a road so that the base 11 is fixed to the installation part by curing a fixing member 2 injected into the groove 1. The road stud 10 may also include a cap 13 that has elastic restoring force and has a dome shape in which a flange 13*a* is formed on an outer diameter so that the flange 13*a* is fitted and fixed in the groove between the mounting step 11*b* and the locking step 11*c* of the base 11 to generate air pressure by external pressure. The road stud 10 may also include a light reflection portion 15 adhesively fixed to a height surface of the base 11 and reflecting ambient light, and a sound generation portion 16 that directly radiates sound to the outside by air pressure generated while the cap 13 is pressed while being fitted and fixed in a path passing through the inner space S of the base 11 from an outside of the light reflection portion 15 and while pressing and fixing the reflection portion 15 to an outer surface of the base 11.

Herein, in an embodiment of the present disclosure, the base 11 is a block body of a "⊔" shape as a whole made of a synthetic resin material. An outer upper peripheral portion and a lower peripheral portion may protrude in a horizontal direction relative to the surface of the light reflection portion 15.

The base 11 is formed in a circular shape as an embodiment, but the base 11 is not limited thereto and may be formed in a polygonal shape including an oval or a quadrangle.

The coupling part 11*a* of the base 11 of an embodiment of the present disclosure as described above is a polygonal or "+"-shaped through hole, which may be formed in an upwardly protruding part (shown in the attached drawing) or a downwardly protruding part (not shown in the attached drawing) from a central bottom surface of the body.

In addition, the mounting step 11*b* of the base 11 may be a protruding part at a distance from the protruding part where the coupling part 11*a* is formed on an edge of the inner bottom surface and the height surface of the base 11 body.

In addition, the space S of the base 11 may be an annular space formed between the protruding part where the mounting step 11*b* and the coupling part 11*a* are formed or a space partitioned with a gap.

Figure 5:
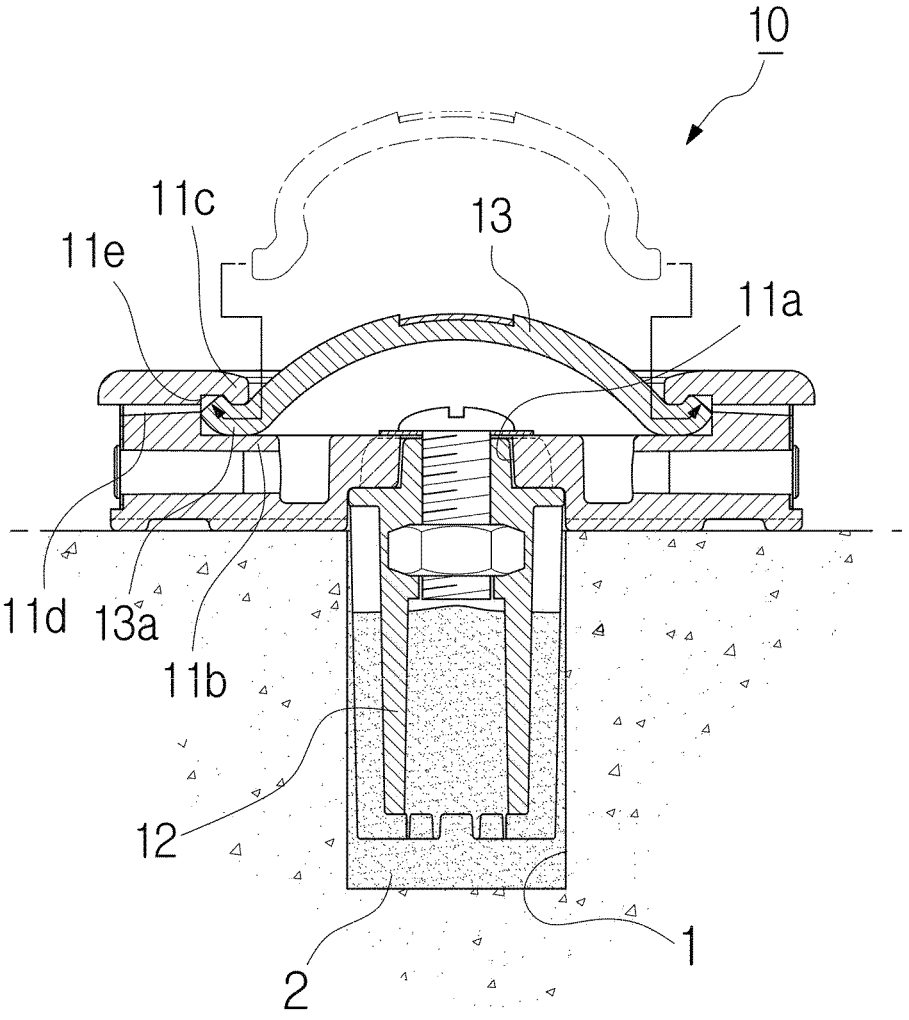
FIG. 5 is a side cross-sectional view illustrating another structure in which the cap is fitted and coupled to the base of an embodiment of the present disclosure.

In addition, the locking step 11*c* of the base 11 may be a protruding part formed in parallel with an upper surface of the mounting step 11*b*, and as illustrated in FIG. 5 of the accompanying drawings, a locking groove 11*e* may be formed on the surface on which the upper edge of the inner height surface of the base 11 located between the mounting step 11*b* is located.

In addition, the drainage path 11*d* of the base 11 may be inclined downward while going from an inside direction to an outside direction.

The fixing portion 12 of an embodiment of the present disclosure is a tubular fixture in which the flange 12*c* may be formed on an upper outer circumference made of a synthetic resin material. A base coupling member 12*a* may be formed in the flange 12*c* to protrude from an upper surface of the flange 12*c* so as to be fitted and coupled to correspond to the coupling part 11*a* of the base 11. A screw coupling hole for fixing the base 11 may be formed in the center of the base coupling member 12*a*, and the slit or rib 12*b*, which is a path through which the fixing member 2 penetrates before curing, may be formed on an outer circumference of a tube body formed on a lower surface of the flange 12*c*.

A nut may be further provided on the inside of the tube body located on a lower surface of the flange 12*c* of the fixing portion 12 to increase durability or fastening holding force when the screw for fixing the base 11 is fastened. The nut may be provided during insert injection molding into the fixing portion 12.

The cap 13 of an embodiment of the present disclosure may have a light reflection member 17 provided in the groove 13*b* formed on an upper surface of the cap 13.

The cap 13 may further display a logo 18 of government agencies and its affiliated organizations, local governments, or companies on an upper surface of the cap 13.

In addition, the cap 13 may be fitted and coupled to the locking groove 11*e* formed on an upper surface of the locking step 11*c* of the base 11 after the outer edge of the flange 13*a* is bent upward.

In an embodiment of the present disclosure, the light reflection portion 15 may be a reflector including a reflective tape, a reflective film, a reflective sheet, and a reflective block that reflects the light of a vehicle (headlamp) at night or in the dark to facilitate identification (including retroreflectors). In an embodiment of the present disclosure, a reflective tape is intended to be applied as an embodiment.

In an embodiment of the present disclosure, the sound generation portion 16 may be a squeaker that generates a sound by air pressure applied from the inside (so-called beeper).

Hereinbefore, in the sound generation portion 16, the part in contact with the light reflection portion 15 is expanded, and the light reflection portion 15 may be pressed, adhered, and fixed to the height surface of the base 11 in order to be inserted into the through hole.

Figure 3:
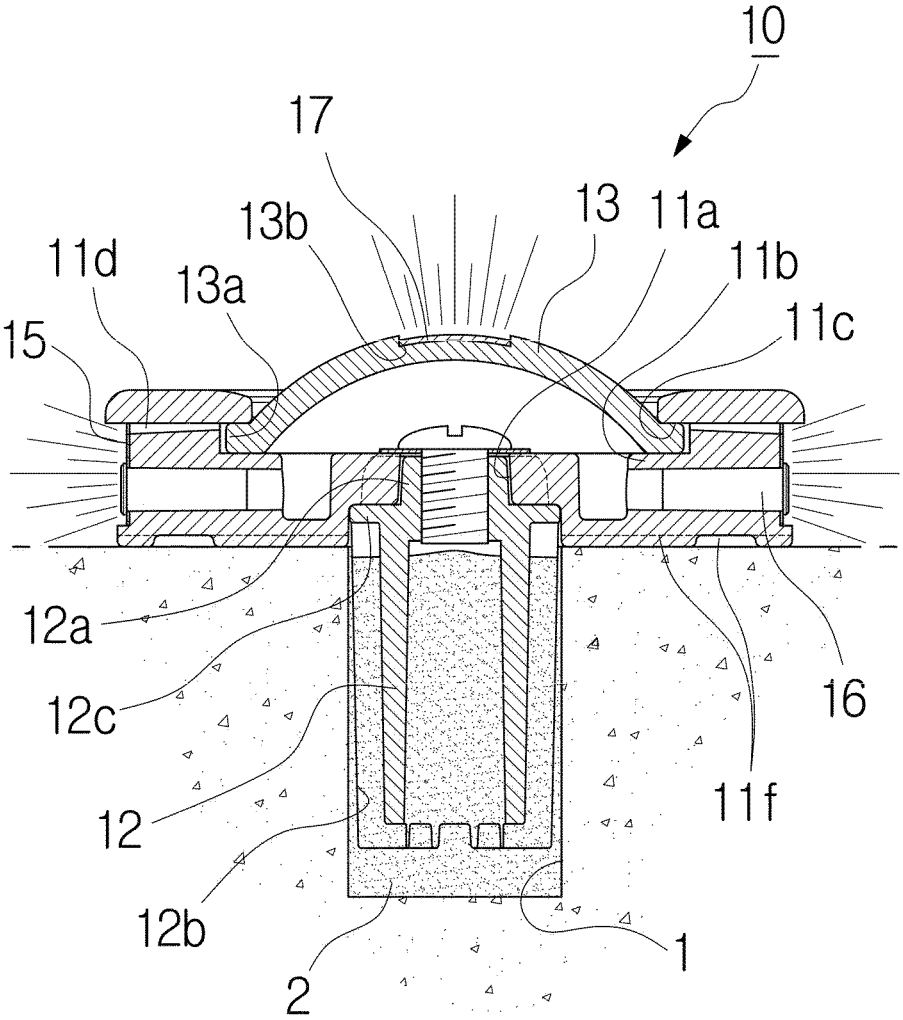
FIG. 3 is a side cross-sectional view illustrating a light reflection state in a state installed on the configuration or structure and installation part of an embodiment of the present disclosure.

As illustrated in FIG. 3 of the accompanying drawings, the present disclosure basically enables identification because the light reflection portion 15 provided on an external height surface of the base 11 reflects the light of the headlamp of a vehicle at night or when it is dark.

The light reflection member 17 provided along the groove 13*b* of an upper portion of the cap 13 additionally reflects light to increase the night discrimination.

Figure 4:
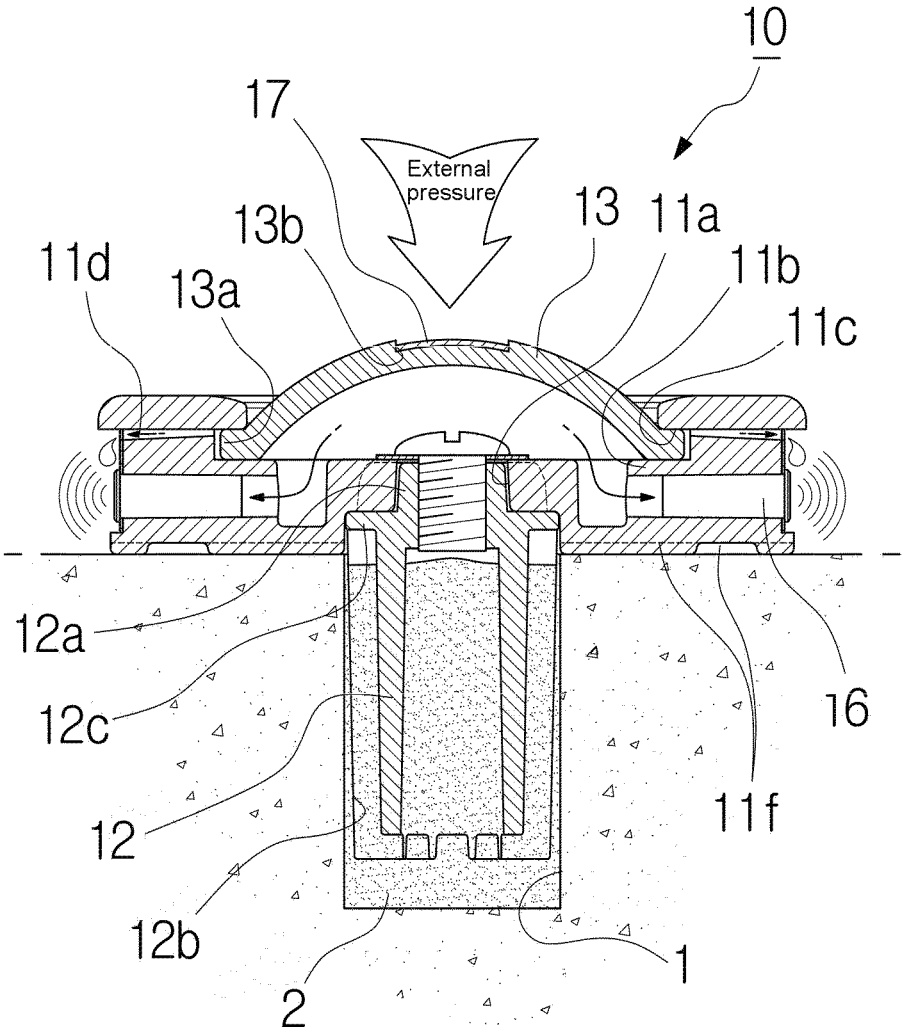
FIG. 4 is a side cross-sectional view illustrating a state in which a warning sound is output by external pressure in a state of being installed in the configuration or structure and installation part of an embodiment of the present disclosure.

In addition, in an embodiment of the present disclosure, as illustrated in FIG. 4 of the accompanying drawings, the sound generation portion 16 fixed to an external height surface of the base 11 with one end exposed generates a sound by the air flow and air pressure applied from the inside due to the cap 13 being pressed.

The sound generation portion 16 is fixed in a wedge type, and it is preferably fixed by force fitting and fixing or helical coupling.

The road stud of an embodiment of the present disclosure assembled in this way is fixed to the ground of the road. When the cap 13 is pressed by a load applied when the tire steps on the cap 13 and then passes while a vehicle is driven, the flow and air pressure of the air are generated in the space S between the base 11 and the cap 13. Accordingly, the air is discharged through the sound generation portion 16, and a trembling plate vibrates, thus generating the sound to provide an auditory warning signal to a driver.

In an embodiment of the present disclosure as described above, one end of the sound generation portion 16 is expanded in a flange form larger than the through hole. The end penetrates the light reflection portion 15 that is primarily adhesively fixed to an external height surface of the base 11 so that a secondary fixing is made to the base 11. The fixing force is increased than simply when the light reflection portion 15 is adhesively fixed to an outer surface of the base 11.

In addition, an embodiment of the present disclosure prevents detachment or damage of the light reflection portion 15 by increasing the fixing force over where the light reflection portion is simply adhesively fixed to a height surface of the base 11. This extends the maintenance period of the road stud 10 and simultaneously reduces costs.

In addition, in an embodiment of the present disclosure, because the sound generation portion 16 is exposed to the side of the base 11, the cap 13 is pressed to generate a flow of air, that is, air pressure. Thereby, the sound generated from the sound generation portion 16 is spread directly to the outside, so that the sound for warning is clearly transmitted to a driver.

An embodiment of the present disclosure is useful when a vehicle is driven, but is not limited thereto, and it is also possible to prevent an accident by outputting a warning sound even when a pedestrian steps thereon to call attention to the pedestrian.

In particular, an embodiment of the present disclosure facilitates a mounting and detachment of the cap 13 with respect to the base 11. This is done by fitting and fixing the flange 13*a* in a closed state by pressing both upper sides of the cap 13 formed of the dome shape in a groove formed between the mounting step 11*b* formed to protrude on an inner edge of the body of the base 11 and the locking step 11*c* formed to protrude inward in a state in which an outer upper end of the body protrudes upward, or by lifting the upper both sides of the cap 13, which is fitted and fixed as described above while pressing the same, so that the flange 13*a* is departed and detached from the groove.

In addition, an embodiment of the present disclosure greatly reduces the installation and maintenance work time of the road stud 10 by facilitating a mounting and detachment of the cap 13 with respect to the base 11 as described above, thereby minimizing the exposure of workers to hazards on the road.

In addition, an embodiment of the present disclosure provides two to four drainage paths 11*d* from an inner surface between the mounting step 11*b* and the locking step 11*c* of the base 11 toward an outer direction of the body. When rainwater or road washing water flows between the locking step 11*c* and the cap 13 of the base 11, the water is quickly discharged, thereby preventing contamination inside the road stud 10, as well as preventing loss of function of a squeaker, which is the sound generation portion 16, caused when the introduced rainwater or washing water penetrates the sound generation portion 16.

In addition, in an embodiment of the present disclosure, the drain 11*f* is provided in the form of a groove radially on a lower surface of the base 11, so that water flowing on the road during rain or road washing does not stay on or around the lower surface of the road stud 10. The water is allowed to flow out quickly. Accordingly, it is possible to prevent rainwater or washing water accumulated in the vicinity from flowing into the road stud 10.

In addition, in an embodiment of the present disclosure, in a state in which the fixing portion 12 is inserted into the groove 1 into which the fixing member 2 made of a liquid or fluid material such as epoxy is injected, by curing the fixing member 2 and allowing the fixing portion 12 to be firmly fixed to an installation part, it is possible to maintain firm fixing force of the base 11 to the installation part.

In addition, in an embodiment of the present disclosure, the actual fixing of the base 11 to an upper portion of the fixing portion 12 is made by screws (bolts) to facilitate replacement of the base 11, which is easily damaged or destroyed by friction or pressure with a tire according to the driving of a vehicle. In addition, the cap 13 is also easily replaced by the above-described detachable structure. By making it easy to replace, an economic improvement is obtained in the part that disassembles and stores the road stud 10 at the time of road repaving and enables reuse.

In addition, in an embodiment of the present disclosure, the coupling part 11*a*, which is a through-hole configuring the base 11, and the base coupling member 12*a*, which is a protruding part configuring the fixing portion 12, are formed in a polygonal or "+" shape. The shape prevents the base 11 from rotating with respect to the fixing portion 12 to which it is coupled, and thus, prevents wear and a generation of a gap of the coupling part, thereby increasing coupling holding force.

In addition, in an embodiment of the present disclosure, it is also preferable that a nut is further provided on the inside of the tube body located on a lower surface of the flange 12*c* of the fixing portion 12. As an example, the nut may be provided during insert injection molding into the fixing portion 12.

In this way, the durability of the fixing portion 12 made of a synthetic resin material is increased, and the fastening holding force is increased when the screw for fixing the base 11 is fastened.

In addition, an embodiment of the present disclosure increases the fixing force on an installation part by forming the slit or rib 12*b*, which is a path through which the fixing member 2 penetrates before curing, on an outer circumference of the fixing portion 12.

In addition, in an embodiment of the present disclosure, by attaching or printing the light reflection member 13*c* to the groove 13*b* formed on an upper surface of the cap 13, in addition to the light reflection portion 15 provided on an external height surface of the base 11, the visibility including night discrimination is further improved. Even when the base 11 goes inside the ground of the road due to external pressure for a long period of time, the light reflection member 13*c* provided on an upper portion of the cap 13 is always exposed to the outside, thereby obtaining the effect of semi-permanently maintaining light reflection function.

In addition, in an embodiment of the present disclosure, a logo of government agencies and its affiliated organizations or local governments or companies is printed or displayed in engraving/embossing shapes on an upper surface of the cap 13, thereby clearly displaying an installer or management subject of the road stud 10 according to an embodiment of the present disclosure.

In addition, in an embodiment of the present disclosure, the sound generation portion 16 penetrates the light reflection portion 15 that is primarily adhesively fixed to a height surface of the base 11 so that a secondary fixing is made to the base 11. The fixing force is increased than simply when the light reflection portion 15 is adhesively fixed to a height surface of the base 11.

Next, an explanation of the installation process of the road stud 10 according to an embodiment of the present disclosure is the same as illustrated in FIGS. 6 or 7 to 9 of the accompanying drawings.

Figure 6:
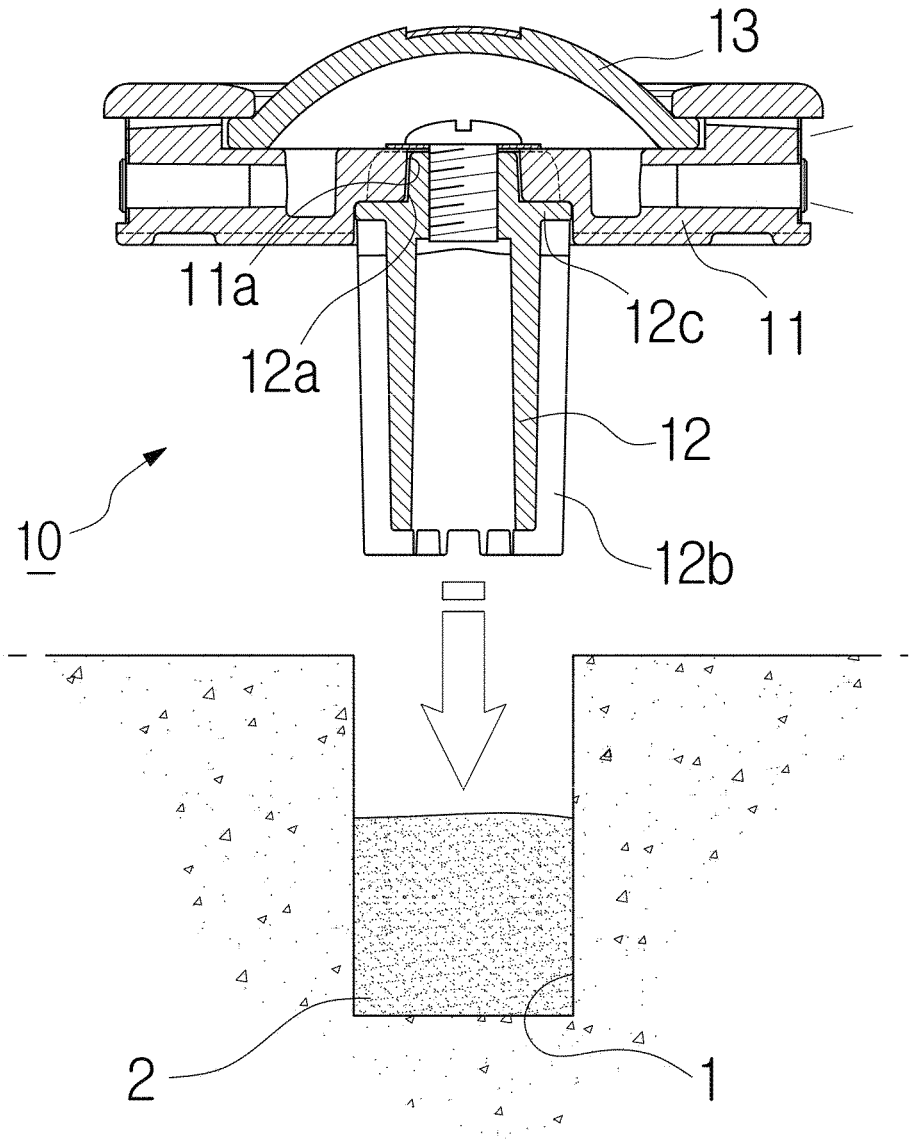
FIG. 6 is a side cross-sectional view illustrating an example in which an embodiment of the present disclosure is installed in the installation part.

As illustrated in FIG. 6 of the accompanying drawings, the groove 1 is formed in an installation part of a road, that is, a roadway, and the fixing member 2 made of a liquid or fluid material such as epoxy is injected into the groove 1.

In this state, by fixing the base 11 to the fixing portion 12 and fixing the cap 13 on an upper portion of the base 11, the fixing portion 12 located at a lower end of the road stud 10, which is a pre-assembled finished product, is inserted into the groove 1.

Then, the fixing member 2 is cured while penetrating between the slit or rib 12*b* formed on an outer circumference of the fixing portion 12, and the fixing is made solid.

Figure 7:
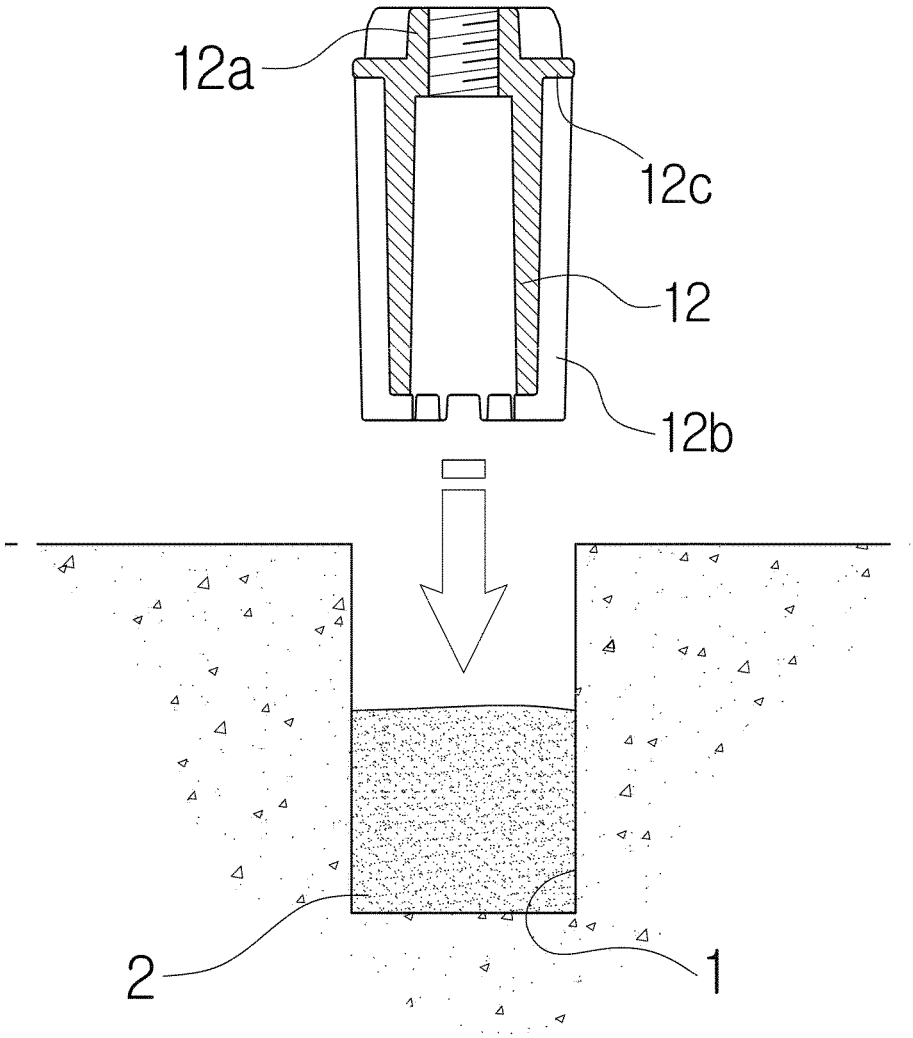
FIGS. 7 to 10 are side cross-sectional views illustrating in stages another example in which an embodiment of the present disclosure is installed in the installation part.

As an example of another installation process in an embodiment of the present disclosure, as illustrated in FIG. 7 of the accompanying drawings, the groove 1 is formed in an installation part of a road, that is, a roadway, and the fixing member 2 made of a liquid or fluid material such as epoxy is injected into the groove 1, and the fixing portion 12 is inserted into the groove 1.

Figure 8:
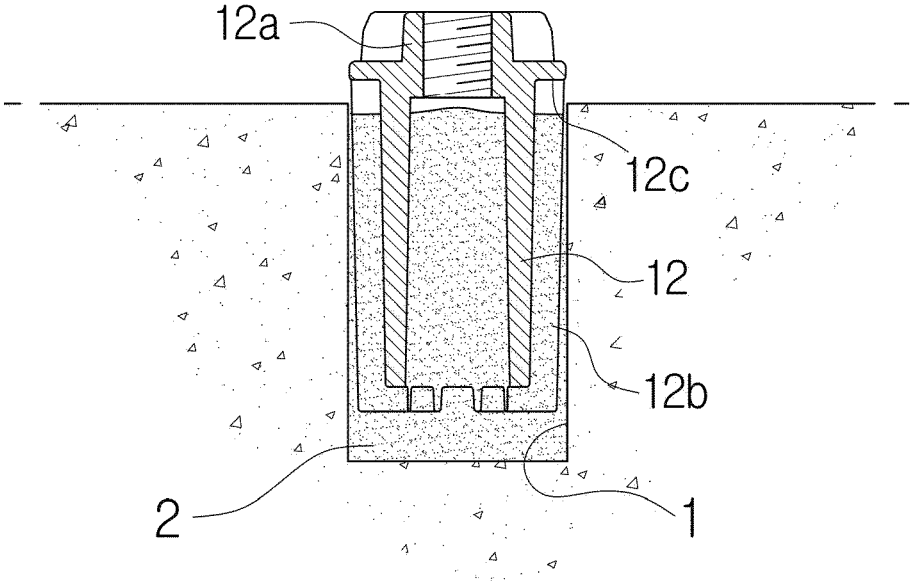
Figure 9:
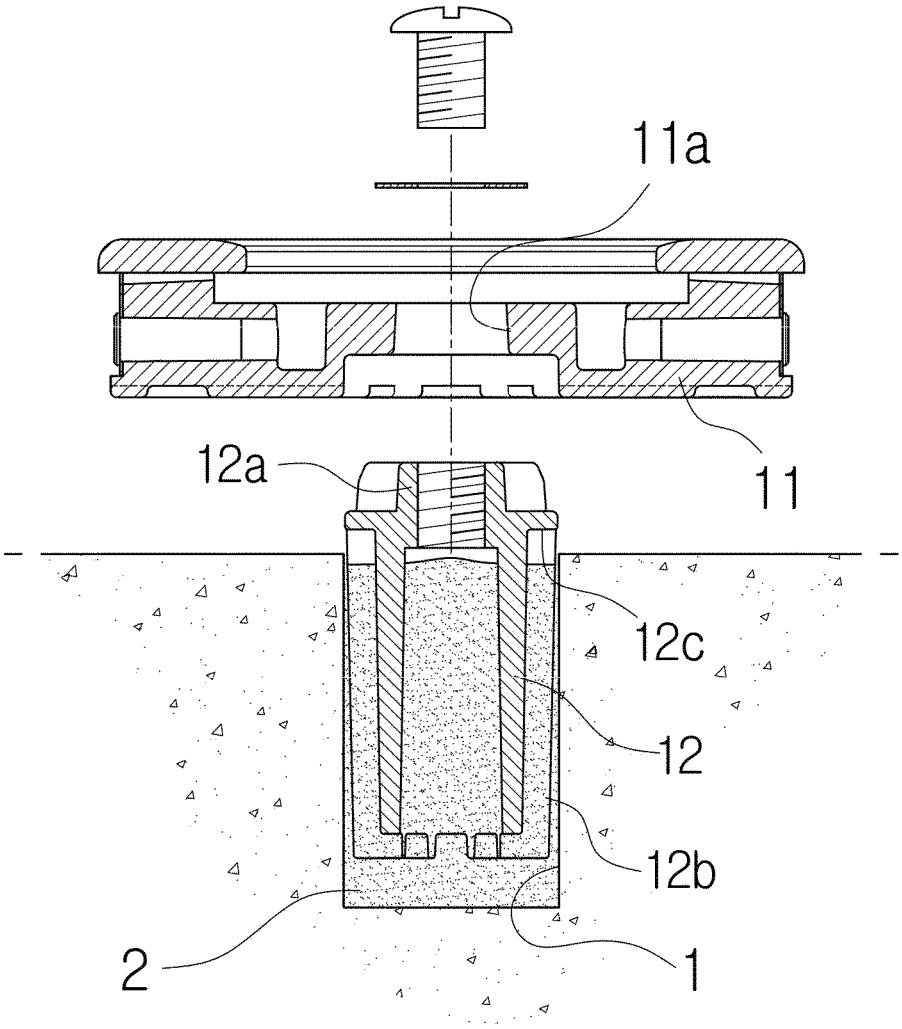

Then, as illustrated in FIG. 8 of the accompanying drawings, the fixing member 2 is cured while penetrating between the slit or rib 12*b* formed on an outer circumference of the fixing portion 12, and the fixing is made solid. As illustrated in FIG. 9 of the accompanying drawings, before or after the fixing member 2 is cured, after inserting the coupling part 11*a* of the base 11 into the base coupling member 12*a* of the fixing portion 12, the base 11 is tightened and fixed to the fixing portion 12 by using a flat washer and a screw or bolt.

Figure 10:
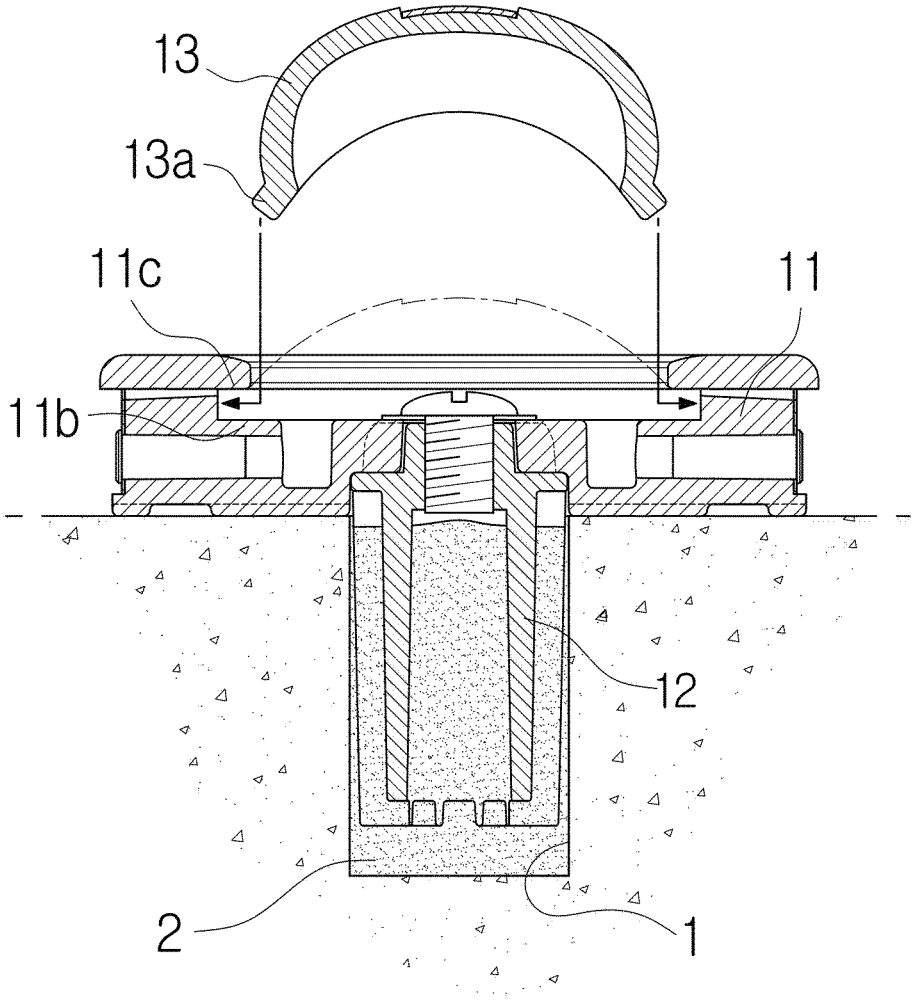

Then, as illustrated in FIG. 10 of the accompanying drawings, the flange 13*a* is fitted and fixed in a closed state by pressing both upper sides of the cap 13.

Hereinbefore, although the present disclosure has been illustrated and described in connection with the preferred embodiments to illustrate the principle of the present disclosure, the present disclosure is not limited to the configurations and operations that have been illustrated and described as described above.

In addition, it will be well understood by those skilled in the art that pluralities of changes and modifications can be made to the present disclosure without departing from the spirit and scope of the attached claims.

Therefore, all these appropriate changes and modifications and equivalents thereto should be considered to fall within the range of the present disclosure.

What is claimed is:

1. A road stud, comprising:

a base in which a coupling part is formed through a center of a body with an inner space formed, a mounting step is formed to protrude on an inner edge of the body, a locking step is formed to protrude inward in a state in which an outer upper end of the mounting step protrudes upward, a drainage path is provided in an outer direction of the body from an inner surface between the mounting step and the locking step, and a drain is provided in the form of a groove radially on a lower surface;

a fixing portion in which an upper end is inserted and screwed into the coupling part of the base and a lower end is inserted into a groove formed at an installation part of a road so that the base is fixed to the installation part by curing a fixing member injected into the groove;

a cap that has elastic restoring force and has a dome shape in which a flange is formed on an outer circumference so that the flange is fitted and fixed in the groove between the mounting step and the locking step of the base to generate air pressure by external pressure;

a light reflection portion that is adhesively fixed to a height surface of the base and reflects ambient light; and a sound generation portion that directly radiates sound to the outside by air pressure generated while the cap is pressed while being fitted and fixed in a path passing through the inner space of the base from an outside of the light reflection portion and while pressing and fixing the light reflection portion to an outer surface of the base.

2. The road stud of claim 1, wherein the coupling part of the base is a polygonal or "+"-shaped through hole, which through hole is formed in an upwardly protruding part or a downwardly protruding part from a central bottom surface of the body.

3. The road stud of claim 1, wherein the fixing portion is a tubular fixture in which a flange is formed on an upper outer circumference made of a synthetic resin material, in which a base coupling member is formed to protrude from an upper surface of the flange so as to be fitted and coupled to correspond to the coupling part of the base, a screw coupling hole for fixing the base is formed in the center of the base coupling member, and a slit or rib, which is a path through which the fixing member penetrates before curing, is formed on an outer circumference of a tube body formed on a lower surface of the flange.

4. The road stud of claim 1, wherein a light reflection member is provided in a groove formed on an upper surface of the cap.

5. The road stud of claim 1, wherein the cap is characterized in that a logo of a government, an affiliated organization, a local government, or a company is displayed on an upper surface of the cap.

6. The road stud of claim 2, wherein the fixing portion is a tubular fixture in which a flange is formed on an upper outer circumference made of a synthetic resin material, in which a base coupling member is formed to protrude from an upper surface of the flange so as to be fitted and coupled to correspond to the coupling part of the base, a screw coupling hole for fixing the base is formed in the center of the base coupling member, and a slit or rib, which is a path through which the fixing member penetrates before curing, is formed on an outer circumference of a tube body formed on a lower surface of the flange.

7. The road stud of claim 2, wherein the cap is characterized in that a light reflection member is provided in a groove formed on an upper surface.

8. The road stud of claim 2, wherein the cap is characterized in that a logo of a government, an affiliated organization, a local government, or a company is displayed on an upper surface of the cap.

9. The road stud of claim 3, wherein the cap is characterized in that a light reflection member is provided in a groove formed on an upper surface.

10. The road stud of claim 3, wherein the cap is characterized in that a logo of a government, an affiliated organization, a local government, or a company is displayed on an upper surface of the cap.

11. The road stud of claim 4, wherein the cap is characterized in that a logo of a government, an affiliated organization, a local government, or a company is displayed on an upper surface of the cap.

* * * * *